US009640042B2

(12) United States Patent
Zong

(10) Patent No.: US 9,640,042 B2
(45) Date of Patent: May 2, 2017

(54) CASH REGISTER

(71) Applicant: ZHEJIANG XKESHI NETWORK TECHNOLOGY CO., LTD., Hangzhou, Zhejiang province (CN)

(72) Inventor: Yongliang Zong, Hangzhou (CN)

(73) Assignee: Zhejiang Xkeshi Network Technology Co., Ltd. (CN)

( * ) Notice: Subject to any disclaimer, the term of this patent is extended or adjusted under 35 U.S.C. 154(b) by 0 days.

(21) Appl. No.: 15/033,645

(22) PCT Filed: Mar. 16, 2015

(86) PCT No.: PCT/CN2015/074279

§ 371 (c)(1),
(2) Date: May 1, 2016

(87) PCT Pub. No.: WO2016/029679

PCT Pub. Date: Mar. 3, 2016

(65) Prior Publication Data

US 2016/0300456 A1 Oct. 13, 2016

(30) Foreign Application Priority Data

Aug. 25, 2014 (CN) ..... 2014 2 0480788 U

(51) Int. Cl.
*G07G 1/00* (2006.01)

(52) U.S. Cl.
CPC ..... *G07G 1/0018* (2013.01); *G07G 1/00* (2013.01)

(58) Field of Classification Search
USPC ..... 235/7 R, 379, 380, 383; 705/16, 17
See application file for complete search history.

(56) References Cited

U.S. PATENT DOCUMENTS 4,280,034 A * 7/1981 Ezaki ..... G07G 1/0018 235/1 D
5,924,079 A * 7/1999 Brown ..... G06Q 20/20 235/381
5,933,812 A * 8/1999 Meyer ..... G06Q 20/20 235/380
6,469,802 B1 * 10/2002 Yamaguchi ..... F16M 11/10 16/337
2003/0222140 A1 * 12/2003 Wasson ..... G07G 1/0018 235/383
2005/0156024 A1 * 7/2005 Ichikawa ..... G07G 1/0018 235/379
2007/0038517 A1 * 2/2007 Lin ..... G07G 1/0018 705/17

(Continued)

*Primary Examiner* — Daniel Hess
(74) *Attorney, Agent, or Firm* — PROI Intellectual Property US

(57) ABSTRACT

The present invention relates to a cash register comprising a frame. A monitor, a POS terminal, and a base are provided on the top of the frame, in a slot in the middle of the frame, and at the bottom end of the frame, respectively. The POS terminal is provided with a button for popping up the slot. A bearing is provided in the middle of a mounting plate in a cavity at the bottom of the frame. The bottom of the frame and the base arranged at the bottom end of the frame are connected by the bearing and a connecting shaft which is provided on the base and matched with the bearing. Clamping holes are formed on the base at two sides of the connecting shaft. A ball is provided in each of the clamping holes.

4 Claims, 4 Drawing Sheets

(56) References Cited

U.S. PATENT DOCUMENTS

| | | | | |
|---|---|---|---|---|
| 2010/0057620 | A1* | 3/2010 | Li | G06Q 20/202 705/71 |
| 2011/0055032 | A1* | 3/2011 | Chen | G06Q 20/204 705/17 |
| 2011/0259672 | A1* | 10/2011 | Kuo | G06Q 30/02 186/59 |
| 2013/0262248 | A1* | 10/2013 | Kim | G07G 1/0018 705/17 |
| 2014/0197298 | A1* | 7/2014 | Chen | F16M 11/10 248/558 |
| 2015/0088755 | A1* | 3/2015 | Sobel | G06Q 20/40145 705/71 |

* cited by examiner

CASH REGISTER

CROSS REFERENCE TO RELATED APPLICATIONS

The present application is the US national stage of International Patent Application PCT/CN2015/074279 filed on Mar. 16, 2015, which, in turn, claims priority to Chinese Patent Application CN 201420480788.6 filed on Aug. 25, 2014.

TECHNICAL FIELD OF THE INVENTION

The present invention relates to the field of machinery, and in particular to a cash register.

BACKGROUND OF THE INVENTION

With the rapid development of economy, paying with a card has become a mainstream payment mode. POS terminals can be seen everywhere in malls, hotels or business sites of all sizes. The traditional cash registers are mostly designed in such a manner that a single POS terminal is connected to a computer and the monitor of the connected computer is fixed at a specified position with its screen facing the operator and its back facing the consumers. A consumer has to turn his/her head toward the operator to see the consumption items displayed on the screen before card wiping, and then passes his/her card to the operator for card wiping. Such an operation way is quite inconvenient for both consumers and operators to some extent, and is both time and labor consuming.

With regard to this problem in the related technologies, no effective solution has bee proposed.

SUMMARY OF THE INVENTION

In view of this problem in the related technologies, the present invention provides a cash register which can solve this problem in the related technologies.

The technical solution of the present invention is realized as below.

A cash register is provided, including a frame; a monitor, a POS terminal, and a base are provided on the top of the frame, in a slot in the middle of the frame, and at the bottom end of the frame, respectively; a buckle is provided in a recess on the top end of the slot, a first slot is provided in the buckle, a first pushrod which is horizontally arranged is connected into the first slot, and the free end of the first pushrod is vertically connected with a second pushrod; spindle noses are provided on left and right sides of the bottom end of the slot, a spring is mounted in the left spindle nose, a semicircular hobbing is mounted at an end of the right spindle nose close to the frame, and a buffering hobbing fitting the semicircular hobbing is provided below the semicircular hobbing; a first recess and a card swiping recess are provided on the top end of the POS terminal; a mounting plate is provided in a cavity on the bottom of the frame, a bearing is provided in the middle of the mounting plate, the bottom of the frame and the base arranged at the bottom end of the frame are connected by the bearing and a connecting shaft which is provided on the base and matched with the bearing; clamping holes are formed on the base at two sides of the connecting shaft, a ball is provided in each of the clamping holes, and the free end of a first spring connected to the ball is fixed onto the mounting plate.

Further, a button is provided at the free end of the second pushrod, and a button hole matched with the button is formed on a casing of the frame.

Further, the spindle nose and the buffering hobbing are both mounted on a first mounting plate on two sides at the bottom end of the slot.

Further, a cover plate is provided on the top end of the bearing and the connecting shaft, and the cover plate is fixed onto a shaft sleeve of the connecting shaft by screws.

The present invention has the following beneficial effects. The cash register is easy to operate and convenient to use. The bottom of the frame and the base are connected to each other via the bearings, thus implementing left-right rotation of the entire machine. By means of rotation resistance produced by the interaction among the ball, the first spring, and the clamping holes, the entire machine is stopped rotating when rotated by 180°, at which angle the POS terminal and the monitor directly face the consumers, and the POS terminal can be popped up for card swiping by pressing the button on the frame.

BRIEF DESCRIPTION OF THE DRAWINGS

To make technical solutions in embodiments of the present disclosure or in the prior art more clearly, the accompanying drawings to be used in the description of embodiments or the prior art will be introduced briefly. It is apparent for a person of ordinary skill in the art that the accompanying drawings to be described below are merely some embodiments of the present disclosure, and other drawings may be obtained according to those drawings without paying any creative effort.

FIG. 4 is a sectional view of part C-C of FIG. 1, in which:

1: frame;
2: monitor;
3: POS terminal;
4: base;
5: recess;
6: buckle;
7: first slot;
8: first pushrod;
9: second pushrod;
10: spring;
11: semicircular hobbing;
12: buffering hobbing;
13: first recess;
14: mounting plate;
15: bearing;
16: connecting shaft;
17: clamping hole;
18: ball;
19: first spring;
20: button;
21: first mounting plate;
22: cover plate; and
23: screw.

DETAILED DESCRIPTION OF THE INVENTION

The technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

Figure 1:
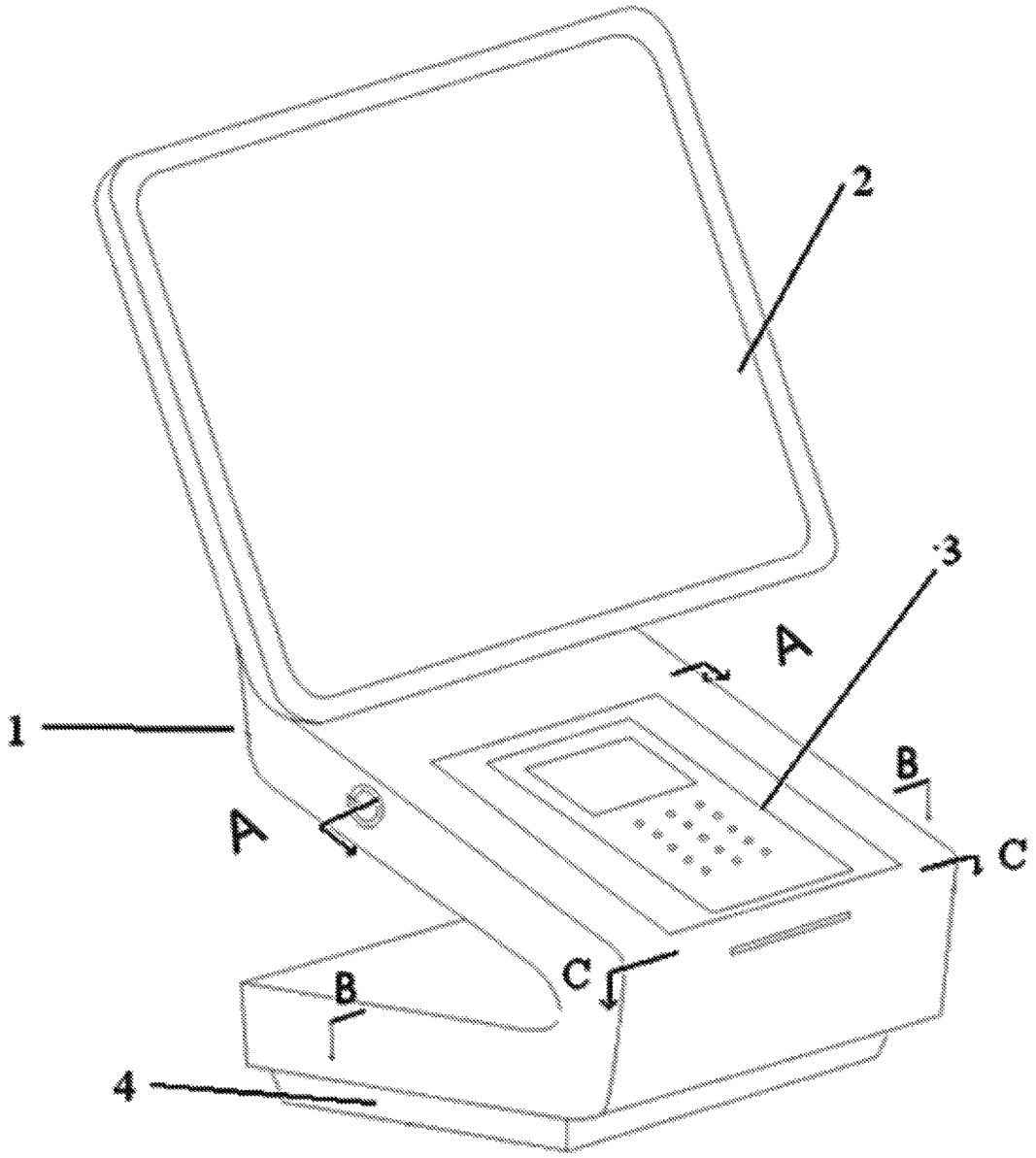
FIG. 1 is a structure diagram of a cash register according to an embodiment of the present invention.
Figure 2:
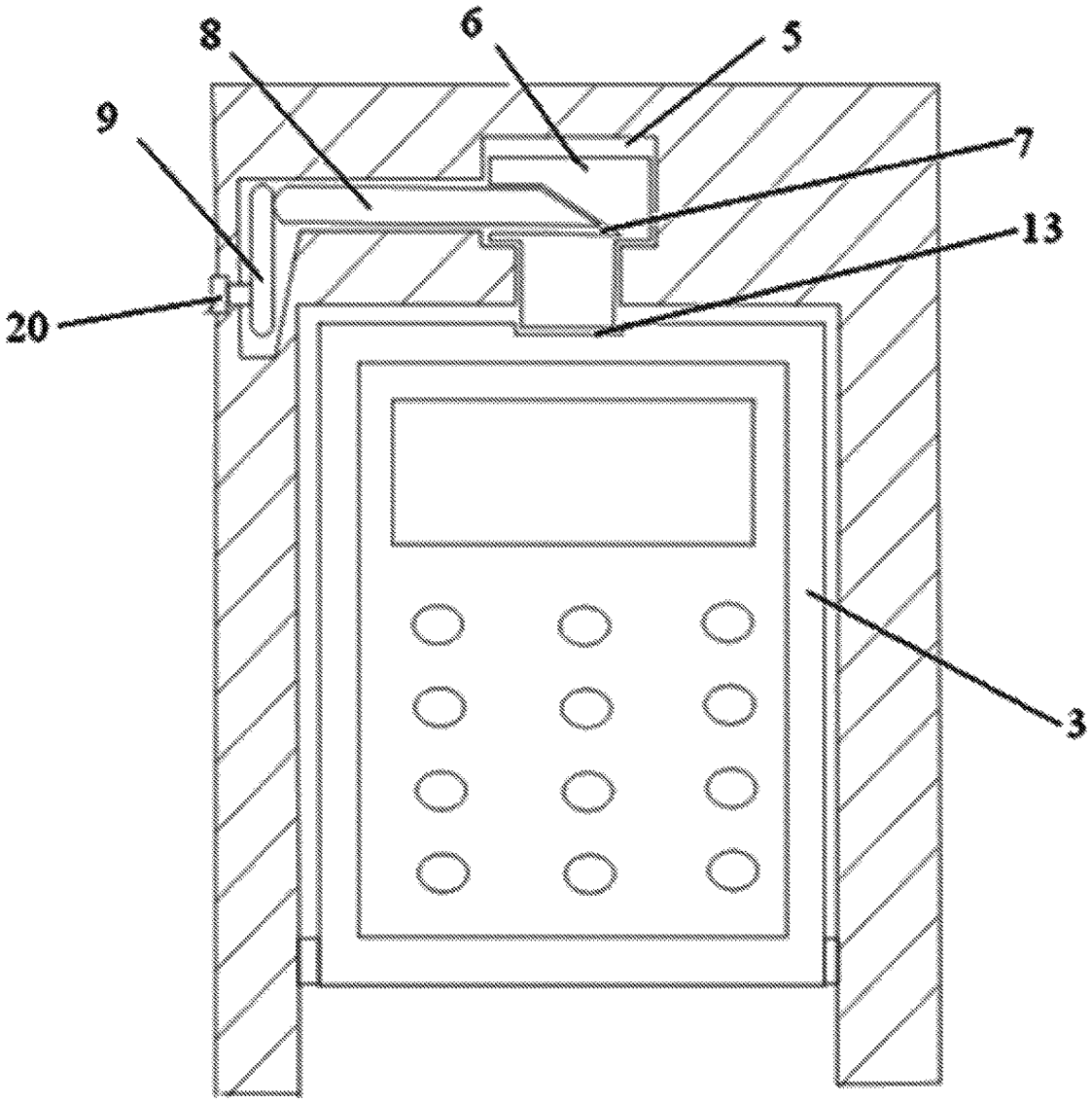
FIG. 2 is a sectional view of part A-A of FIG. 1.
Figure 3:
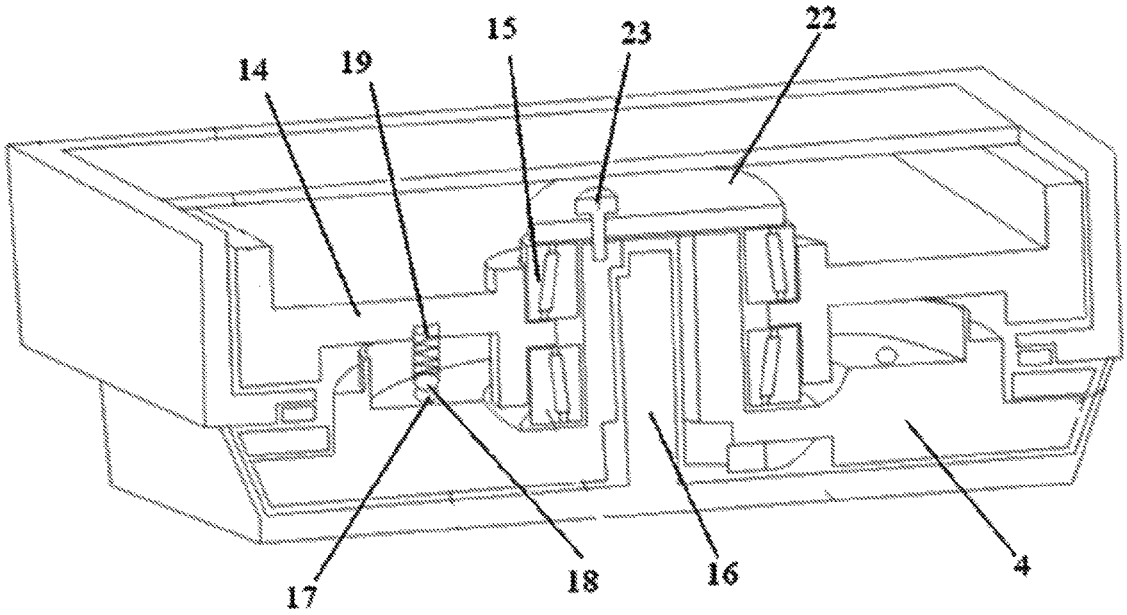
FIG. 3 is a sectional view of part B-B of FIG. 1.
Figure 4:
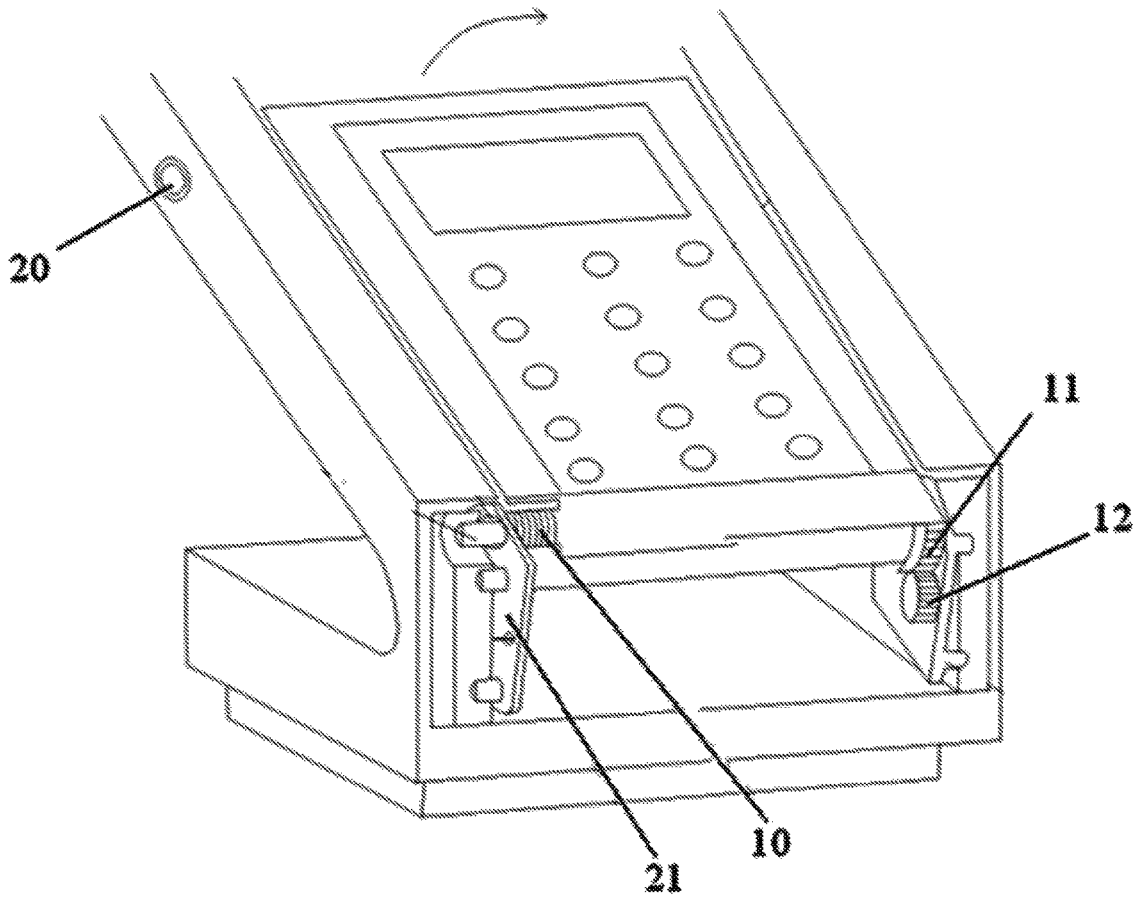

As shown in FIG. 1 to FIG. 3, according to an embodiment of the present invention, a cash register is provided, including a frame 1; a monitor 2, a POS terminal 3, and a base 4 are provided on the top of the frame 1, in a slot in the middle of the frame 1, and at the bottom end of the frame 1, respectively; a buckle 6 is provided in a recess 5 on the top end of the slot, a first slot 7 is provided in the buckle 6, a first pushrod 8 which is horizontally arranged is connected into the first slot 7, and the free end of the first pushrod 8 is vertically connected with a second pushrod 9; spindle noses are provided on left and right sides of the bottom end of the slot, a spring 10 is mounted in the left spindle nose, a semicircular hobbing 11 is mounted at an end of the right spindle nose close to the frame 1, and a buffering hobbing 12 fitting the semicircular hobbing 11 is provided below the semicircular hobbing 11; a first recess 13 and a card swiping recess are provided on the top end of the POS terminal 3; a mounting plate 14 is provided in a cavity on the bottom of the frame 1, a bearing 15 is provided in the middle of the mounting plate 14, the bottom of the frame 1 and the base 4 arranged at the bottom end of the frame 1 are connected by the bearing 15 and a connecting shaft 16 which is provided on the base 4 and matched with the bearing 15; clamping holes 17 are formed on the base 4 at two sides of the connecting shaft 16, a ball 18 is provided in each of the clamping holes 17, and the free end of a first spring 19 connected to the ball 18 is fixed onto the mounting plate 14.

By pressing the button 20, under the action of the first pushrod 8 and the second pushrod 9, the buckle 6 is clamped into the recess 13 to drive the POS terminal to pop up. Under the action of the spring 10, the semicircular hobbing 11 and the buffering hobbing 12, the POS terminal is allowed to pop up slowly, thereby avoiding its quick popup to damage the machine. Under the action of the bearing 15 and the connecting shaft 16, the rotation of the entire machine is realized. When the entire machine rotates by 180°, the opposite acting force stressed by the ball 18 onto the first spring 19 is increased and it is hard to increase the rotation angle of the entire machine, and at this angle, the monitor 2 directly faces the consumers and it is convenient for the consumers to wipe their cards.

A button 20 is provided at the free end of the second pushrod 9, and a button hole matched with the button 20 is formed on a casing of the frame 1.

The spindle nose and the buffering hobbing 12 are both mounted on a first mounting plate 21 on two sides at the bottom end of the slot.

A cover plate 22 is provided on the top end of the bearing 15 and the connecting shaft 16, and the cover plate 22 is fixed onto a shaft sleeve of the connecting shaft 16 by screws 23.

During the use, when an operator enters the consumption items, he/she rotates the frame by 180° as a whole, and at this angle, the monitor 2 directly faces the consumers; and then, the operator presses the button 20 to allow the POS terminal 3 to pop up. The consumers wipe their cards directly after checking their consumption items. After confirmation, the monitor 2 is rotated to the operator. Now, the whole operation ends.

In conclusion, with the technical solutions of the present invention, the cash register is easy to operate and convenient to use; the bottom of the frame and the base are connected to each other via the bearings, thus implementing left-right rotation of the entire machine; by means of rotation resistance produced by the interaction among the ball, the first spring, and the clamping holes, the entire machine is stopped rotating when rotated by 180°, at which angle the POS terminal and the monitor directly face the consumers, and the POS terminal can be popped up for card swiping by pressing the button on the frame.

The foregoing descriptions are merely specific implementations of the present disclosure, and not used for limiting the present invention. Any modifications, equivalent replacements and improvements made within the spirit and scope of the present invention shall be included in the protection scope of the present invention.

What is claimed is:

1. A cash register comprising a frame, characterized in that a monitor, a POS terminal, and a base are provided on the top of the frame, in a slot in the middle of the frame, and at the bottom end of the frame, respectively; a buckle is provided in a recess on the top end of the slot, a first slot is provided in the buckle, a first pushrod which is horizontally arranged is connected into the first slot, and the free end of the first pushrod is vertically connected with a second pushrod; spindle noses are provided on left and right sides of the bottom end of the slot, a spring is mounted in the left spindle nose, a semicircular hobbing is mounted at an end of the right spindle nose close to the frame, and a buffering hobbing fitting the semicircular hobbing is provided below the semicircular hobbing; a first recess and a card swiping recess are provided on the top end of the POS terminal; a mounting plate is provided in a cavity on the bottom of the frame, a bearing is provided in the middle of the mounting plate, the bottom of the frame and the base arranged at the bottom end of the frame are connected by the bearing and a connecting shaft which is provided on the base and matched with the bearing; clamping holes are formed on the base at two sides of the connecting shaft, a ball is provided in each of the clamping holes, and the free end of a first spring connected to the ball is fixed onto the mounting plate.

2. The cash register according to claim 1, characterized in that a button is provided at the free end of the second pushrod, and a button hole matched with the button is formed on a casing of the frame.

3. The cash register according to claim 2, characterized in that the spindle nose and the buffering hobbing are both mounted on a first mounting plate on two sides at the bottom end of the slot.

4. The cash register according to claim 3, characterized in that a cover plate is provided on the top end of the bearing and the connecting shaft, and the cover plate is fixed onto a shaft sleeve of the connecting shaft by screws.

* * * * *